US008249481B2

(12) United States Patent
Takenouchi et al.

(10) Patent No.: US 8,249,481 B2
(45) Date of Patent: Aug. 21, 2012

(54) DEVELOPING DEVICE, IMAGE FORMING APPARATUS INCLUDING THE SAME AND DEVELOPING METHOD

(75) Inventors: Kohichi Takenouchi, Nara (JP); Mitsuru Tokuyama, Kyoto (JP); Kiyofumi Morimoto, Nara (JP); Hiroo Naoi, Nara (JP); Kazuma Hinoue, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 888 days.

(21) Appl. No.: 12/217,449

(22) Filed: Jul. 3, 2008

(65) Prior Publication Data

US 2009/0010669 A1 Jan. 8, 2009

(30) Foreign Application Priority Data

Jul. 4, 2007 (JP) ..... 2007-176647

(51) Int. Cl.
*G03G 15/00* (2006.01)

(52) U.S. Cl. ..... 399/74; 399/27; 399/44; 399/61; 399/62; 358/408; 358/504; 347/19

(58) Field of Classification Search ..... 399/27, 399/44, 49, 62, 74, 82; 358/406, 504; 347/19
See application file for complete search history.

(56) References Cited

U.S. PATENT DOCUMENTS

| | | | | |
|---|---|---|---|---|
| 5,311,261 | A * | 5/1994 | Nakagama et al. | 399/63 |
| 5,343,233 | A * | 8/1994 | Abe | 347/119 |
| 7,346,286 | B2 * | 3/2008 | Matsumoto et al. | 399/29 |
| 7,697,854 | B2 * | 4/2010 | Itoyama et al. | 399/30 |
| 2002/0170973 | A1 | 11/2002 | Teraura | |
| 2006/0193650 | A1 | 8/2006 | Takenouchi et al. | |
| 2007/0053703 | A1 * | 3/2007 | Hirayama | 399/27 |
| 2007/0122169 | A1 * | 5/2007 | Shimizu et al. | 399/27 |
| 2007/0269228 | A1 * | 11/2007 | Takeuchi et al. | 399/30 |
| 2008/0124107 | A1 * | 5/2008 | Takeuchi et al. | 399/59 |
| 2009/0202261 | A1 * | 8/2009 | Tsukada et al. | 399/30 |
| 2009/0214232 | A1 * | 8/2009 | Murauchi et al. | 399/30 |

FOREIGN PATENT DOCUMENTS

| | | | |
|---|---|---|---|
| JP | 01-291274 | | 11/1989 |
| JP | 02-221967 | | 9/1990 |
| JP | 04264472 | A * | 9/1992 |
| JP | 04336571 | A * | 11/1992 |
| JP | 05-019527 | | 1/1993 |
| JP | 05019629 | A * | 1/1993 |
| JP | 07-234582 | | 9/1995 |
| JP | 10-312089 | | 11/1998 |
| JP | 2002287441 | A * | 10/2002 |
| JP | 2002-337426 | | 11/2002 |
| JP | 2005-121951 | | 5/2005 |

(Continued)

*Primary Examiner* — David Gray
*Assistant Examiner* — Francis Gray
(74) *Attorney, Agent, or Firm* — David G. Conlin; Steven M. Jensen; Edwards Wildman Palmer LLP

(57) ABSTRACT

The change in an output voltage when a control voltage is changed is calculated, and the change in the control voltage divided by the calculated change in the output voltage is defined as a sensitivity coefficient. The sensitivity coefficient is recalculated for each predetermined time interval or whenever a predetermined condition is satisfied, and the control voltage is corrected based on the recalculated sensitivity coefficient. Example of the predetermined condition include the time of start-up of the apparatus, the time at which the accumulated number of printed sheets reaches a predetermined number, and the time of carrying out process control.

5 Claims, 3 Drawing Sheets

FOREIGN PATENT DOCUMENTS

| | | | |
|---|---|---|---|
| JP | 2005121951 A | * | 5/2005 |
| JP | 2006-010749 | | 1/2006 |
| JP | 2006-065180 | | 3/2006 |
| JP | 2006-243214 | | 9/2006 |
| JP | 2006-268034 | | 10/2006 |

* cited by examiner

DEVELOPING DEVICE, IMAGE FORMING APPARATUS INCLUDING THE SAME AND DEVELOPING METHOD

CROSS-REFERENCE TO RELATED APPLICATION

This application claims priority to Japanese Patent Application No. 2007-176647, which was filed on Jul. 4, 2007, the contents of which are incorporated herein by reference in its entirety.

BACKGROUND OF THE INVENTION

1. Field of the Invention

The present invention relates to a developing device including a toner density detecting section in which an output value of detection result changes in accordance with an input control value, an image forming apparatus including the same, and a developing method.

2. Description of the Related Art

An electrophotographic image forming apparatus is widely used, for example, as a copier, a printer, and a facsimile, because a high-quality image can be quickly formed through a simple operation and the maintenance is easily performed. An electrophotographic image forming apparatus includes a photoreceptor, a charging device, an exposure device, a developing device, a transfer device, a fixing device, and a cleaning device. The photoreceptor is a roller-shaped member on which a photosensitive layer is formed. The charging device receives voltage application and charges a surface of the photoreceptor to a predetermined potential. The exposure device applies signal light according to image information to the charged surface of the photoreceptor to form an electrostatic latent image. The developing device supplies toner onto the surface of the photoreceptor to develop the electrostatic latent image into a toner image. The transfer device transfers the toner image on the surface of the photoreceptor to a recording medium. The fixing device fixes, for example, the toner image on the recording medium. An image is thus formed on the recording medium. The cleaning device is a blade-shaped member provided in such a way that the cleaning device abuts on the surface of the photoreceptor, and removes residual toner on the surface of the photoreceptor after the tone image has been transferred to the recording medium.

The developing device includes a developing roller that supplies toner to an electrostatic latent image on the surface of the photoreceptor to form a toner image, a developing tank that stores a two-component developer containing toner and supplies the two-component developer to the developing roller, and a toner density sensor that detects the toner density in the developing tank. The amount of toner to be replenished into the developing tank is controlled in accordance with the detection result obtained from the toner density sensor. The toner density sensor typically outputs a detection result as a voltage, and the output voltage is likely affected, for example, by the detection sensitivity of the toner density sensor itself and the environment in which the two-component developer is used (temperature, humidity, and a cumulative number of printed sheets). For example, the detection sensitivity of the toner density sensor varies with temperature, humidity, and other factors. The detection sensitivity of the toner density sensor also varies, for example, with the speed of printing an image and with number of printed images in the image forming apparatus. In a color image forming apparatus, the detection result from the toner density sensor changes in accordance with a color of toner. Therefore, an adequate amount of toner may not be replenished to the developing tank in some cases, sometimes resulting in reduced image density, faint images, and other problems.

In the image forming apparatus described in Japanese Unexamined Patent Publication JP-A 2005-121951, the input voltage to the toner density sensor is modified, for example, in accordance with temperature, humidity, and the cumulative amount of printed sheets.

In developing devices having toner densities initially set to values similar to one another in consideration of the variation in sensitivity of the toner density sensors, even when printing is performed in similar aging conditions, the toner density control, such as the timing of toner replenishment, may be different among the developing devices. Therefore, after a certain length of time has passed and hence the developer gets degraded, the variation in sensitivity of the toner density sensors has changed and hence differs from the initial value, so that adequate toner densities cannot be obtained. When a plurality of developing devices are provided, for example, in a color image forming apparatus, the sensitivity of the toner density sensor of a developing device differs from the sensitivities of the toner density sensors of the other developing devices, and hence the toner consumption will be different among the developing devices when the whole image forming apparatus is concerned.

In the image forming apparatus described in JP-A 2005-121951, the setting value of the toner density sensor is changed, which, however, does not correct the variation in sensitivity of the toner density sensor. Therefore, an adequate toner density cannot be obtained, and hence the toner consumption will differ among the developing devices.

SUMMARY OF THE INVENTION

An object of the invention is to provide a developing device and method capable of achieving an adequate toner density, and further to provide an image forming apparatus in which toner consumptions of developing devices make no difference.

The invention provides a developing device comprising:

a developing roller that supplies toner to an electrostatic latent image formed on a surface of a photoreceptor to form a toner image;

a developing tank that stores a two-component developer containing toner;

a toner density detecting section that detects a toner density in the developing tank and outputs a detection result, an output value of a detection result changing in accordance with an input control value;

a correcting section that calculates a sensitivity coefficient indicative of a correlation between the control value and the output value and corrects the control value based on the calculated sensitivity coefficient; and a toner density calculating section that calculates the toner density in the developing tank using the detection result obtained from the toner density detecting section to which a corrected control value is inputted, the correction section recalculating the sensitivity coefficient for each predetermined time interval or whenever a predetermined condition is satisfied, and correcting the control value based on the recalculated sensitivity coefficient.

According to the invention, the toner density detecting section detects a toner density in the developing tank and outputs a detection result, and an output value of the detection result can be changed in accordance with an input control value.

The correction section calculates a sensitivity coefficient indicative of a correlation between the control value and the output value and corrects the control value based on the calculated sensitivity coefficient. The toner density calculating section calculates the toner density in the developing tank using the detection result obtained from the toner density detecting section to which the corrected control value is inputted.

The correction section recalculates a sensitivity coefficient for each predetermined time interval or each time a predetermined condition is satisfied, and corrects the control value based on the recalculated sensitivity coefficient.

In this way, even when the developer is used for a certain period of time, the toner density can be accurately detected and an adequate toner density can be obtained.

Further, in the invention, it is preferable that the predetermined condition is a time of start-up of the apparatus, a time at which the accumulated number of printed sheets reaches a predetermined number, or a time of carrying out process control.

According to the invention, the sensitivity coefficient is recalculated when the apparatus is activated, when the cumulative number of printed images reaches a predetermined number, or when process control is carried out. It is therefore possible to provide an adequate toner density corresponding to the situation when the sensitivity coefficient is recalculated.

Further, in the invention, it is preferable that the developing device further comprises a temperature sensor that detects a temperature in the apparatus environment, and the correction section corrects the control value based on a temperature detected by the temperature sensor.

According to the invention, by such constitution, it is therefore possible to handle the change in temperature and obtain a more adequate toner density.

Further, in the invention, it is preferable that the developing device further comprises a humidity sensor that detects a relative humidity in the apparatus environment, and the correction section corrects the control value based on a humidity detected by the humidity sensor.

According to the invention, by such constitution, it is therefore possible to handle the change in humidity and obtain a more adequate toner density.

Further, the invention provides an image forming apparatus for forming an image with electrophotography, comprising a plurality of the developing devices mentioned above, each of the developing devices including a modifying section that modifies a sensitivity coefficient depending on the provided toner density detecting section, and the correcting section correcting the control value based on the sensitivity coefficient modified by the modifying section.

According to the invention, the image forming apparatus includes a plurality of the developing devices mentioned above and forms an image with electrophotography. Each of the developing devices includes a modifying section that modifies the sensitivity coefficient depending on the provided toner density detecting section. The correcting section corrects the control value based on the sensitivity coefficient modified by the modifying section.

In this way, an image can be formed without causing a difference in toner consumption among the developing devices.

Further, the invention provides a developing method in which toner is supplied to an electrostatic latent image formed on a surface of a photoreceptor to form a toner image, the method comprising the steps of:

calculating a sensitivity coefficient indicative of a correlation between a control value and an output value for each predetermined time interval or whenever a predetermined condition is satisfied;

correcting the control value based on the calculated sensitivity coefficient;

outputting a detection result of the toner density in a developing tank in accordance with the corrected control value; and calculating the toner density in the developing tank using the detection result of the toner density.

According to the invention, a sensitivity coefficient indicative of a correlation between a control value and an output value is calculated for each predetermined time interval or whenever a predetermined condition is satisfied and the control value is corrected based on the calculated sensitivity coefficient. A detection result of the toner density in a developing tank is outputted in accordance with the corrected control value, and the toner density in the developing tank is calculated using the detection result of the toner density.

In this way, even when the developer is used for a certain period of time, the toner density can be accurately detected and an adequate toner density can be obtained.

Further, the invention provides a computer-readable recording medium on which an image processing program that causes a computer to operate the image forming apparatus mentioned above is recorded.

According to the invention, a computer-readable recording medium on which an image formation program that causes a computer to operate the image forming apparatus is recorded can be provided.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
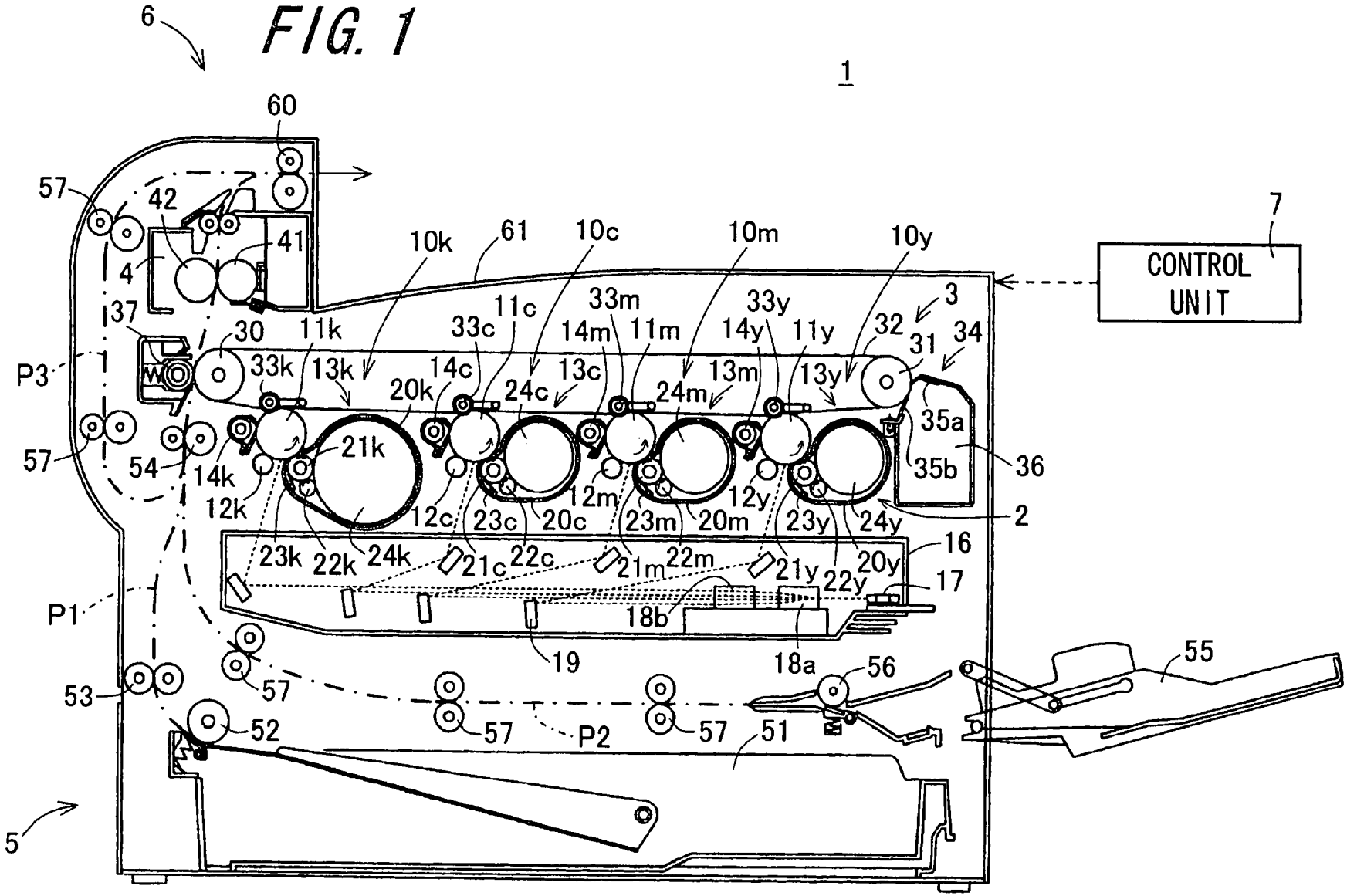
FIG. 1 is a cross-sectional view schematically showing the configuration of an image forming apparatus according to an embodiment of the invention.

Now referring to the drawings, preferred embodiments of the invention are described below.

Figure 2:
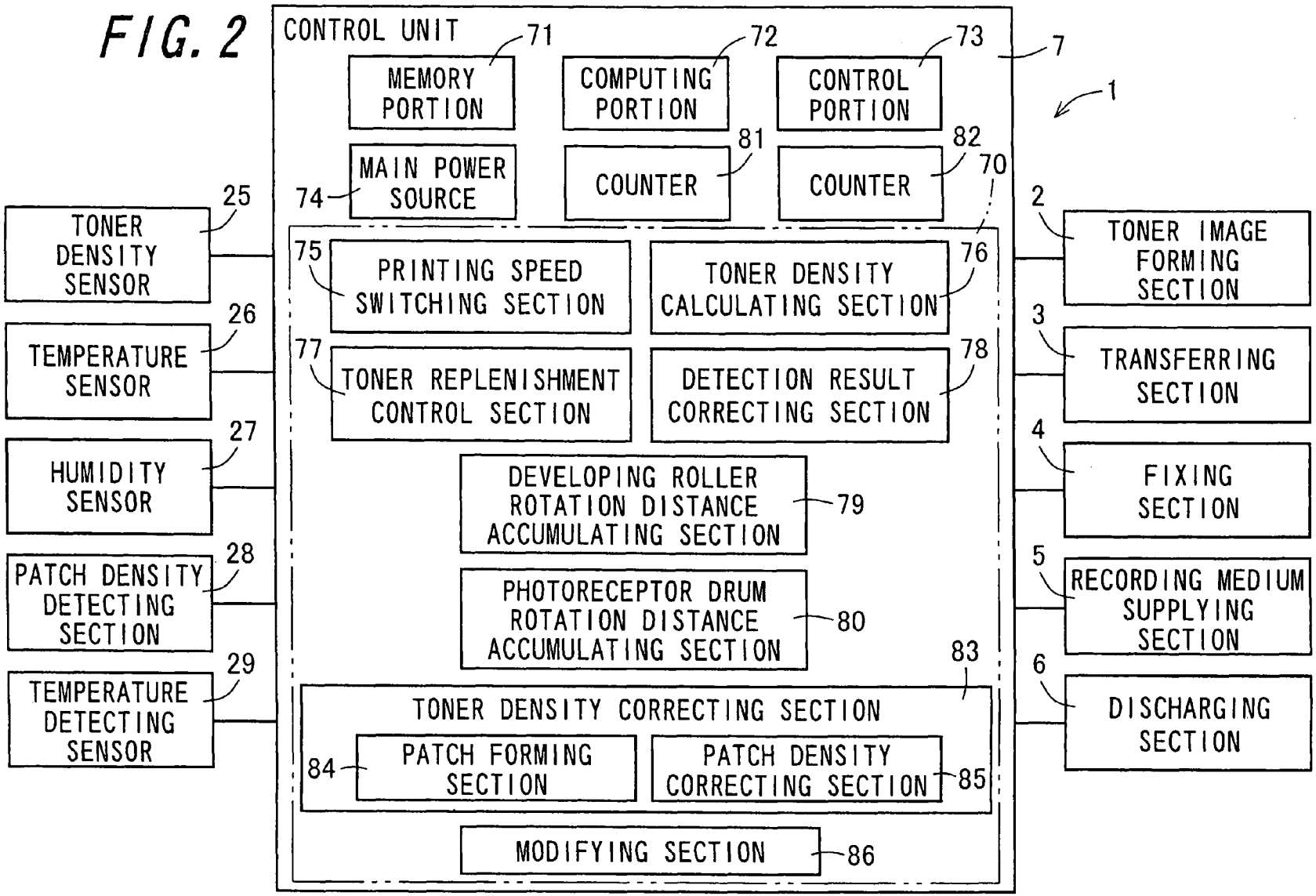
FIG. 2 is a schematic block diagram showing electrical constitution of the image forming apparatus.

FIG. 1 is a cross-sectional view schematically showing the configuration of an image forming apparatus 1 according to an embodiment of the invention. FIG. 2 is a schematic block diagram showing electrical constitution of the image forming apparatus 1. The image forming apparatus 1 is a multifunctional printer having a printer function and a facsimile function and forms a full-color or monochrome image on a recording medium in accordance with transmitted image information. That is, the image forming apparatus 1 has two printing modes, a printer mode and a facsimile mode, and a control unit 7 is used to select the printer mode or the facsimile mode, for example, in response to an operation input from an operation section (not shown), or a printing job received from a personal computer, a portable terminal, an information recording/storing medium, or an external apparatus using a memory device.

Three types of printing modes are set in the image forming apparatus 1: a monochrome image printing mode, a color image printing mode, and a cardboard printing mode. In the monochrome image printing mode, a monochrome image is printed at a monochrome image printing speed. The monochrome image printing speed is the fastest of the printing speeds in the three printing modes. In the color image printing mode, a color image is printed at a color image printing speed. The color image printing speed is faster than the printing speed in the cardboard printing mode. In the cardboard printing mode, an image is printed on a cardboard sheet at a cardboard printing speed. Cardboard herein is recording paper having a basis weight of 106 $g/m^2$ to 300 $g/m^2$. The cardboard printing mode can also be selected manually by using an operation panel (not shown) provided in a vertically upper portion of the image forming apparatus 1. In the embodiment, the process speed and the printing speed are set as follows: In the monochrome image forming mode (high-speed printing mode), the process speed is 255 mm/sec and the printing speed is 45 sheets/min. In the color image forming mode (medium-speed printing mode), the process speed is 167 mm/sec and the printing speed is 35 sheets/min. In the cardboard printing mode (low-speed printing mode), the process speed is 83.5 mm/sec and the printing speed is 17.5 sheets/min.

The image forming apparatus 1 includes a toner image forming section 2, a transferring section 3, a fixing section 4, a recording medium supplying section 5, a discharging section 6, and a control unit 7. Four sets of the members that form the toner image forming section 2 and four sets of part of the members contained in the transferring section 3 are provided in order to handle image information on the following colors: black (k), cyan (c), magenta (m), and yellow (y) contained in color image information. In the embodiment, each of the four sets of the members provided for the respective colors has the alphabetical letter indicative of the corresponding color at the end of the reference numeral and is distinguished from the others. On the other hand, when any of the four sets of the members is collectively referred, only the reference numeral is used.

The toner image forming section 2 includes photoreceptor drums 11, charging sections 12, an exposure unit 16, developing sections 13, and cleaning units 14. The charging section 12, the developing section 13, and the cleaning unit 14 are disposed around the photoreceptor drum 11 in this order from the upstream side of the rotation direction of the photoreceptor drum 11.

The photoreceptor drum 11 is a roller-shaped member supported by a drive section (not shown) in such a way that the photoreceptor drum 11 is rotatable about an axis thereof and having a photosensitive layer on which an electrostatic latent image, which becomes a toner image, is formed. The photoreceptor drum 11 can be, for example, a roller-shaped member including a conductive substrate (not shown) and a photosensitive layer (not shown) formed on the surface of the conductive substrate. The conductive substrate can be shaped into, for example, a hollow cylinder, a solid cylinder, and a sheet. Among the above shapes, a hollow cylindrical conductive substrate is preferred. Examples of the photosensitive layer are an organic photosensitive layer and an inorganic photosensitive layer. The organic photosensitive layer is, for example, a laminate of a charge generating layer, which is a resin layer containing a charge generating substance, and a charge transporting layer, which is a resin layer containing a charge transporting substance; and a resin layer containing both a charge generating substance and a charge transporting substance. The inorganic photosensitive layer is a layer containing one or more components selected from zinc oxide, selenium, amorphous silicon, and the like. An undercoat layer may be interposed between the conductive substrate and the photosensitive layer, and a front surface layer (protective layer) primarily for protecting the photosensitive layer may be provided on the surface of the photosensitive layer.

The charging section 12 is a roller-shaped member provided in such a way that the charging section 12 is pressed against the photoreceptor drum 11. A power supply (not shown) is connected to the charging section 12 and applies a voltage to the charging section 12. The charging section 12 receives the voltage application from the power supply and charges the surface of the photoreceptor drum 11 to a predetermined polarity and potential. A roller-shaped charging section is used in the embodiment, but the charging section 12 is not limited thereto. The charging section 12 may be a charging brush-type charger, a charging-type charger, a sawtooth-type charger, an ion generator, and a contact-type charger, such as a magnetic brush.

The exposure unit 16 is a laser scanning unit including a light emitter (not shown), a polygonal mirror 17, a first fθ lens 18*a*, a second fθ lens 18*b*, and a plurality of reflective mirrors 19. The exposure unit 16 applies signal light to the charged surface of the photoreceptor drum 11 to form an electrostatic latent image according to image information. The light emitter emits signal light according to image information. The light emitter can be, for example, a light source, such as a semiconductor laser and an LED array. Such a light source may be combined with a liquid crystal shutter. The polygonal mirror 17 rotates at a uniform angular speed and deflects the signal light emitted from the light emitter. The first and second fθ lenses 18*a* and 18*b* separate the signal light deflected by the polygonal mirror 17 into signal light beams corresponding to yellow, magenta, cyan, and black image information and directs the signal light beams toward the reflective mirrors 19 corresponding to the respective colors. The reflective mirrors 19 reflect the color signal light beams that have exited through the first and second fθ lenses 18*a* and 18*b* toward the photoreceptor drums 11 corresponding to the respective colors. In this way, electrostatic latent images corresponding to the respective colors are formed on the photoreceptor drums 11*y*, 11*m*, 11*c*, and 11*k*.

The developing section 13 includes a developing tank 20, a developing roller 21, a supplying roller 22, a layer thickness restricting member 23, a toner cartridge 24, and a toner density sensor 25. Note that, a developing device is realized by the developing section 13 and the control unit 7.

The developing tank 20 is a container-shaped member disposed so as to face the surface of the photoreceptor drum 11, and the inner space of the developing tank 20 houses the developing roller 21, the supplying roller 22, the layer thickness restricting member 23, and the toner cartridge 24, as well as a developer. The developer can be a one-component developer containing only toner, or a two-component developer containing toner and a carrier. An opening is formed in the side surface of the developing tank 20 that faces the photoreceptor drum 11, and the surface of the photoreceptor drum 11 faces the developing roller 21 through the opening.

The developing roller 21 is a roller-shaped member that is rotatably supported by the developing tank 20 and rotated about an axis thereof by a drive section (not shown). The developing roller 21 is disposed in such a way that an axis thereof is parallel to the axis of the photoreceptor drum 11. The developing roller 21 bears a developer layer on a surface thereof. In the portion where the developing roller 21 is pressed against the photoreceptor drum 11 (developing nip portion), the developing roller 21 supplies toner to the electrostatic latent image on the surface of the photoreceptor drum 11 and develops the electrostatic latent image to form a toner image. A power supply (not shown) is connected to the developing roller 21. When toner is supplied, the power supply applies a potential having a polarity opposite to that of the potential of the charged toner to the surface of the developing roller 21 as a developing bias voltage (hereinafter simply referred to as "developing bias"). In this way, the toner on the surface of the developing roller 21 is smoothly supplied to the electrostatic latent image. Further, changing the developing bias value allows the amount of toner supplied to the electrostatic latent image (the amount of toner to be attached) to be controlled.

The supplying roller 22 is a roller-shaped member that is rotatably supported by the developing tank 20 and rotated about an axis thereof by a drive section (not shown). The supplying roller 22 is disposed so as to face the photoreceptor drum 11 with the developing roller 21 therebetween. The supplying roller 22 is rotated to supply the developer in the developing tank 20 to the surface of the developing roller 21 and mix the developer in the developing tank 20 with the toner discharged from toner cartridge 24, which will be described later. The layer thickness restricting member 23 is a plate-shaped member disposed in such a way that one end thereof is supported by the developing tank 20 and the other end abuts on the surface of the developing roller 21. The layer thickness restricting member 23 restricts the thickness of the developer layer on the surface of the developing roller 21.

The toner cartridge 24 is a hollow cylindrical container-shaped member removably attached to a main body of the image forming apparatus 1, and an inner space of the toner cartridge 24 stores toner. The toner cartridge 24 is disposed so as to be rotatable about an axis thereof by a drive section provided in the image forming apparatus 1. A toner discharging port (not shown) extending in the axial direction of the toner cartridge 24 is formed in the axial side surface of the toner cartridge 24, and the toner is discharged from the toner discharging port into the developing tank 20 when the toner cartridge 24 rotates. The amount of toner discharged from the toner cartridge 24 per revolution of the toner cartridge 24 is substantially the same. Therefore, the amount of toner replenished to the developing tank 20 can be controlled by controlling the rotational speed of the toner cartridge 24.

The toner density sensor 25 serves as a toner density detecting section, and is, for example, attached to the bottom of the developing tank vertically under the supplying roller 22 in such a way that the sensor surface is exposed to the interior of the developing tank 20. The toner density sensor 25 is electrically connected to a control unit 7.

A toner density sensor 25 is provided for each of the toner image forming sections 2*y*, 2*m*, 2*c*, and 2*k*. The control unit 7 causes the toner cartridges 24*y*, 24*m*, 24*c*, and 24*k* to rotate so as to replenish toner into the developing tanks 20*y*, 20*m*, 20*c*, and 20*k* in accordance with the detection results obtained from the toner density sensors 25. The toner density sensor 25 can be a typical toner density sensor, such as a transmitted light detecting sensor, a reflected light detecting sensor, and a permeability detecting sensor. Among them, a permeability detecting sensor is preferred.

A permeability detecting sensor has four terminals: a GND (ground) terminal, a drive voltage (24 V) input terminal for driving the sensor, an output terminal: Vout (output: 0 to 5 V, the output voltage value is expressed by 8-bit converted values), and a control voltage input terminal: Vc (input: 0 to 10 V, the input voltage value is expressed by 8-bit converted values). The permeability detecting sensor receives the application of a control voltage and outputs a toner density detection result as an output voltage. The permeability detecting sensor is basically sensitive around the central value of the output voltages, and hence used by applying a control voltage at which an output voltage close to the central value (2.5 V, for example) can be provided.

The output voltage from the toner density sensor 25 changes with time, because the output voltage gradually changes in accordance with the degradation of the developer and the environment in which the toner density sensor 25 is used. Therefore, the control voltage is corrected at predetermined intervals in consideration of variation in sensitivity of the toner density sensor 25 as well as the factors mentioned above. The control unit 7 controls the application of the control voltage to the permeability detecting sensor.

Permeability detecting sensors of this type are commercially available. Examples of such permeability detecting sensors are TS-L, TS-A, and TS-K (all manufactured by TDK Corporation).

After the toner image is transferred to an intermediate transfer belt 32, which will be described later, the cleaning unit 14 removes the toner left on the surface of the photoreceptor drum 11 to clean the surface of the photoreceptor drum 11. The cleaning unit 14 includes a cleaning blade, a first waste toner reservoir, and a waste toner transporting roller. The cleaning blade is a plate-shaped member, one end of which in the short-side direction abuts on the surface of the photoreceptor drum 11 and the other end is supported by the first waste toner reservoir, and scrapes the toner and the like left on the surface of the photoreceptor drum 11. The first waste toner reservoir is a container-shaped member, houses the cleaning blade and the toner transporting roller in the inner space, and temporarily stores the toner and the like scraped by the cleaning blade. The waste toner transporting roller is a roller-shaped member that is rotatably supported by the toner reservoir and can be rotated about an axis thereof by a drive section (not shown). The rotation of the waste toner transporting roller transports the toner in the waste toner reservoir into a waste toner tank (not shown) through a toner transporting tube (not shown) connected to the first waste toner reservoir, and the waste toner is stored in the waste toner tank. The waste toner tank, when filled with toner, is replaced with a new waste toner tank.

In the embodiment, a temperature sensor 26 and a humidity sensor 27 are provided in the toner image forming section 2, preferably in the vicinity of the developing section 13, and detect the temperature and humidity around the developing section 13. The temperature sensor 26 and the humidity sensor 27 are electrically connected to the control unit 7, and the detection results from the temperature sensor 26 and the humidity sensor 27 are inputted to the control unit 7. The temperature sensor 26 and the humidity sensor 27 can be typical sensors, even a temperature/humidity sensor. In the embodiment, as the temperature sensor 26 and the humidity sensor 27, a button-type temperature/humidity recorder (trade name: Hygrochron, manufactured by KN Laboratories, Inc.) is used. The control voltage Vc is corrected in accordance with the detection result from the temperature sensor 26 and the humidity sensor 27.

In the embodiment, a patch density detecting section 28 is provided between the downstream side of the developing section 13 and the upstream side of an intermediate transfer nip portion in the direction in which the photoreceptor drum 11 rotates. The patch density detecting section 28 detects the toner density (patch density) of a toner patch formed on the surface of the photoreceptor drum 11 by a patch forming section, which will be described later. The patch density detecting section 28 is electrically connected to the control unit 7 in the image forming apparatus 1, and outputs the detection result to the control unit 7. The control unit 7 controls the toner density of the toner image formed by the toner image forming section 2 in accordance with the detection result obtained from the patch density detecting section 28, for example, by changing the developing bias voltage. Alternatively, the toner density can also be controlled, for example, by adjusting the potential of the charged photoreceptor drum 11 and the potential caused by the exposure performed by the exposure unit 16. The patch density detecting section 28 can be a typical toner density detecting sensor, such as a transmitted light detecting sensor and a reflected light detecting sensor.

In the toner image forming section 2, the exposure unit 16 applies signal light according to image information to the surface of the photoreceptor drum 11, which has been uniformly charged by the charging section 12, to form an electrostatic latent image. The developing section 13 supplies toner to form a toner image, which is then transferred to the intermediate transfer belt 32. The cleaning unit 14 then removes the toner left on the surface of the photoreceptor drum 11. The series of toner image forming operations described above is repeated.

The transferring section 3 includes a drive roller 30, a driven roller 31, the intermediate transfer belt 32, intermediate transfer rollers 33 (*y, m, c*, and *k*), a transfer belt cleaning unit 34, and a transfer roller 37. The transferring section 3 is disposed above the photoreceptor drums 11.

The drive roller 30 is a roller-shaped member that is rotatably supported by a support section (not shown) and can be rotated by a drive section about an axis thereof. The rotation of the drive roller 30 rotates the intermediate transfer belt 32. The drive roller 30 is pressed against the transfer roller 37 with the intermediate transfer belt 32 therebetween. The portion where the drive roller 30 is pressed against the transfer roller 37 is a transfer nip portion. The driven roller 31 is a roller-shaped member rotatably supported by a support section (not shown). The driven roller 31 is rotated by the intermediate transfer belt 32 when it rotates. The driven roller 31 imparts an appropriate tension to the intermediate transfer belt 32 and hence assists smooth rotation of the intermediate transfer belt 32.

The intermediate transfer belt 32 is an endless belt-shaped member that is stretched between the drive roller 30 and the driven roller 31 under tension and forms a loop-shaped travel path. The intermediate transfer belt 32 is driven to rotate as the drive roller 30 rotates. When the intermediate transfer belt 32 passes the photoreceptor drum 11 while coming into contact therewith, the intermediate transfer roller 33, which is disposed on the opposite side of the intermediate transfer belt 32 to the photoreceptor drum 11, applies a transfer bias having a polarity opposite to the polarity of the charged toner on the surface of the photoreceptor drum 11 to the intermediate transfer belt 32, and the toner image formed on the surface of the photoreceptor drum 11 is transferred onto the intermediate transfer belt 32. For a full-color image, color toner images formed on the respective photoreceptor drums 11 are sequentially transferred onto the intermediate transfer belt 32 in such a way that one image is superimposed on another so as to form a full-color toner image.

The intermediate transfer roller 33 is a roller-shaped member that is pressed against the photoreceptor drum 11 with the intermediate transfer belt 32 therebetween and can be rotated about an axis thereof by a drive section (not shown). The intermediate transfer roller 33 is connected to a power supply (not shown) that applies a transfer bias as described above, and serves to transfer the toner image on the surface of the photoreceptor drum 11 to the intermediate transfer belt 32. The portion where the intermediate transfer roller 33 is pressed against the photoreceptor drum 11 is the intermediate transfer nip portion.

The transfer belt cleaning unit 34 includes transfer belt cleaning blades 35*a* and 35*b* and a second waste toner reservoir 36. Each of the transfer belt cleaning blades 35*a* and 35*b* is a plate-shaped member, one end of which in the short-side direction abuts on the surface of the intermediate transfer belt 32 and the other end is supported by the second waste toner reservoir 36. The transfer belt cleaning blades 35*a* and 35*b* are disposed so as to face each other. The transfer belt cleaning blades 35*a* and 35*b* scrape and collect toner, paper dust, and the like left on the surface of the intermediate transfer belt 32. The second waste toner reservoir 36 temporarily stores the toner, paper dust, and the like scraped by the transfer belt cleaning blades 35*a* and 35*b*.

The transfer roller 37 is a roller-shaped member that is pressed against the drive roller 30 with the intermediate transfer belt 32 therebetween by a pressing section (not shown) and can be rotated about an axis thereof by a drive section (not shown). In the transfer nip portion, the toner image borne on and transported by the intermediate transfer belt 32 is transferred onto a recording medium delivered from the recording medium supplying section 5, which will be described later. The recording medium bearing the toner image is delivered to the fixing section 4. In the transferring section 3, the rotation of the intermediate transfer belt 32 transports the toner image, which has been transferred from the photoreceptor drum 11 to the intermediate transfer belt 32 in the intermediate transfer nip portion, to the transfer nip portion, where the toner image is transferred onto a recording medium.

The fixing section 4 is roller-shaped members that include a fixing roller 41 and a pressurizing roller 42 and are disposed downstream of the transferring section 3 in the recording medium conveyance direction. The fixing roller 41 can be rotated about an axis thereof by a drive section (not shown), and heats and melts the toner that forms the unfixed toner image borne on the recording medium to fix the toner on the recording medium. A heating section (not shown) is provided in the fixing roller 41. The heating section heats the fixing roller 41 so that the surface of the fixing roller 41 is heated to a predetermined temperature (heating temperature). The heating section can be, for example, an infrared heater and a halogen lamp. The surface temperature of the fixing roller 41 is maintained at a temperature that has been set in the design phase of the image forming apparatus 1. The surface temperature of the fixing roller 41 is controlled, for example, by using the control unit 7 of the image forming apparatus 1 and a temperature detecting sensor 29 that is disposed in the vicinity of the surface of the fixing roller 41 and detects the surface temperature of the fixing roller 41. The temperature detecting sensor 29 is electrically connected to the control unit 7, and the detection result obtained from the temperature detecting sensor 29 is outputted to the control unit 7. The control unit 7 compares the detection result obtained from the temperature detecting sensor 29 with a previously set temperature, and sends a control signal to a power supply (not shown) that applies a voltage to the heating section to cause heat generation in the heating section so as to increase the surface temperature when the detection result is lower than the set temperature.

The pressurizing roller 42 is pressed against the fixing roller 41 and supported in such a way that the pressurizing roller 42 is driven to rotate as the fixing roller 41 rotates. The portion where the pressurizing roller 42 is pressed against the fixing roller 41 is a fixing nip portion. The pressurizing roller 42 presses the toner against the recording medium when the fixing roller 41 melts the toner and fixes it onto a recording medium so as to assist the operation in which the toner image is fixed to the recording medium. A heating section, such as an infrared heater and a halogen lamp, can be provided in the pressurizing roller 42. In the fixing section 4, a recording medium to which a toner image is transferred in the transferring section 3 is nipped between the fixing roller 41 and the pressurizing roller 42, and the toner image is heated and pressed against the recording medium when the recording medium passes through the fixing nip portion. In this way, the toner image is fixed to the recording medium and an image is formed.

The recording medium supplying section 5 includes a paper feed tray 51, pickup rollers 52 and 56, conveying rollers 53 and 57, registration rollers 54, and a manual paper feed tray 55. The paper feed tray 51 is a container-shaped member that is disposed in a vertically lower portion of the image forming apparatus 1 and stores recording mediums. Examples of the recording mediums include plain paper sheets, color copier sheets, sheets for overhead projector, and postcards. The size of the recording medium includes A3, A4, B4, and B5 sizes. The pickup roller 52 is a roller-shaped member that picks up recording mediums stored in the paper feed tray 51 one by one and delivers them to a paper conveyance path P1. The conveying rollers 53 are a pair of roller-shaped members disposed so as to press each other, and convey a recording medium toward the registration rollers 54. The registration rollers 54 are a pair of roller-shaped members disposed so as to press each other, and deliver the recording medium delivered through the conveying rollers 53 to the transfer nip portion in synchronization with the toner image borne on the intermediate transfer belt 32 and transported to the transfer nip portion. The manual paper feed tray 55 is a device storing recording mediums which are different from the recording mediums stored in the paper feed tray 51 and may have any size and which are to be taken into the image forming apparatus 1. The pickup roller 56 is a roller-shaped member which delivers the recording medium taken into the image forming apparatus 1 from the manual paper feed tray 55 is delivered to a paper conveyance path P2. The paper conveyance path P2 is connected to the paper conveyance path P1 on the upstream side of the recording medium conveyance direction. The conveying rollers 57 are a pair of roller-shaped members disposed so as to press each other, and deliver the recording medium directed into the paper conveyance path P2 by the pickup roller 56 to the registration rollers 54 through the paper conveyance path P1.

The discharging section 6 includes paper discharging rollers 60, a catch tray 61, a plurality of conveying rollers 57. The paper discharging rollers 60 are roller-shaped members disposed so as to press each other in a region downstream of the fixing nip portion in the paper conveyance direction. The paper discharging rollers 60 can be rotated by a drive section (not shown) in forward and reverse directions. The paper discharging rollers 60 discharge the recording medium on which an image is formed in the fixing section 4 onto the catch tray 61 disposed on the vertically upper side of the image forming apparatus 1. When a double-side printing command has been inputted to the control unit 7 of the image forming apparatus 1, the paper discharging rollers 60 temporarily nip the recording medium discharged through the fixing section 4 and then deliver the recording medium toward a paper conveyance path P3. The paper conveyance path P3 is connected to the paper conveyance path P1 on the upstream side of the recording medium conveyance direction with respect to the registration rollers 54. A plurality of conveying rollers 57 are disposed along the paper conveyance path P3, and the recording medium with one side printed, which has been delivered to the paper conveyance path P3 by the paper discharging rollers 60, is transported by the plurality of conveying rollers 57 toward the registration rollers 54 in the paper conveyance path P1.

The image forming apparatus 1 includes the control unit 7. The control unit 7 is disposed in the upper portion of the inner space of the image forming apparatus 1, and includes a memory portion 71, a computing portion 72, and a control portion 73. The memory portion 71 in the control unit 7 receives inputs, such as various setting values via an operation panel (not shown) disposed on the upper side of the image forming apparatus 1, detection results from sensors and the like (not shown) disposed at various locations in the image forming apparatus 1, image information from an external apparatus, and data tables for executing various control operations. Programs for operating various functional elements 70 are also written to the memory portion 71. The memory portion 71 can be a device commonly used in the art. Examples of the memory portion 71 are a read only memory (ROM), a random access memory (RAM), and a hard disk drive (HDD). The external apparatus can be an electric/electronic apparatus that can form or acquire image information and can be electrically connected to the image forming apparatus. Examples of the external apparatus are a computer, a digital camera, a television, a video recorder, a DVD recorder, an HDDVD, a blu-ray disc recorder, a facsimile, and a mobile terminal device. The computing portion 72 extracts various data to be written to the memory portion 71 (such as image formation commands, detection results, and image information) and programs for various functional elements 70, and performs various judgment operations. The control portion 73 sends a control signal, in accordance with a judgment result from the computing portion 72, to the corresponding device and performs control of the operation of the device. The control portion 73 and the computing portion 72 include a processing circuit implemented by, for example, a central processing unit (CPU)-based microcomputer and a microprocessor. The control unit 7 includes a main power source 74 as well as the processing circuit, and the main power source 74 supplies power to not only the control unit 7 but also various devices in the image forming apparatus 1. Here, the various functional elements 70 include a printing speed switching section 75, a toner density calculating section 76, a toner replenishment control section 77, a detection result correcting section 78, a developing roller rotation distance accumulating section 79, a photoreceptor drum rotation distance accumulating section 80, a toner density correcting section 83, a patch forming section 84, a patch density correcting section 85, and a modifying section 86, which will be described later.

In the embodiment, a reference toner density in the developing tank 20 is written to the memory portion 71 in the control unit 7. The reference toner density is set in the design phase of the image forming apparatus 1. A first data table is also written in advance, which indicates the correlation between toner densities in the developing tank 20 and detection results (output voltage values, hereinafter referred to as "density detection result") obtained from the toner density sensor 25 at the monochrome image printing speed, which is most frequently used in the image forming apparatus 1. Specifically, an actual output value (volts) for each toner density obtained from the permeability detecting sensor is measured, and the relationship between the toner density and the actual output value from the permeability detection sensor is determined. The actual output value is converted from an analog value into a digital value (hereinafter referred to as "A-to-D conversion") ranging from 0 to 255 (eight bits). A second data table is then written in advance, which is a correction table used to convert a density detection result at the color image printing speed into a density detection result at the monochrome image printing speed. Further, a third data table is written in advance, which is a correction table used to convert a density detection result at the cardboard printing speed into a density detection result at the monochrome image printing speed. The first to third data tables include data for each of the colors, black (k), magenta (m), cyan (c), and yellow (y). The first to third data tables are set for each model of the image forming apparatus and/or each model of the toner density sensor.

The toner density sensor 25 is provided for each of the developing tanks 20*k*, 20*m*, 20*c*, and 20*y* as described above. The toner density sensor 25 detects the toner density in the developing tank 20 and outputs the detection result as a voltage value to the control unit 7. The output voltage value from the toner density sensor 25 is written to the memory portion 71 in the control unit 7. The detection using the toner density sensor 25 is continuously performed, for example, starting from the point when a printing command is inputted to the control unit 7, allowing a predetermined period to elapse, and ending at the point when the image forming operation is completed. The toner density sensor 25 also detects the toner density in the developing tank 20 when the image forming apparatus 1 is activated.

The printing speed switching section 75 reads the printing speed in printing information contained in a printing command inputted to the control unit 7 and changes the printing speed. The printing speed is the monochrome image printing speed (high), the color image printing speed (middle), or the cardboard printing speed (low). More specifically, the printing speed switching section 75 sends control signals through the control portion 73 in the control unit 7 to various sections required to change the printing speed in accordance with the printing speed readout result, and controls the operation speeds (process speeds) of the sections as well as the printing speed. The readout result obtained from the printing speed switching section 75 is inputted to the memory portion 71. The readout result inputted to the memory portion 71 includes at least the previous readout result and the current readout result. Whenever a new readout result is inputted, the readout result before the previous readout result may be deleted. When a new readout result is inputted, the current readout result is replaced with the new readout result. Comparing the previous readout result with the current readout result allows a judgment to be made whether or not the printing speed has been changed.

The toner density calculating section 76 calculates the toner density in the developing tank 20 using the density detection result in accordance with and the printing speed changed by the printing speed switching section 75. When the printing speed is the monochrome image printing speed, the density detection result and the first data table are extracted from the memory portion 71 and compared with each other. The toner density corresponding to the density detection result is determined in the first data table, and will be used as the toner density in the developing tank 20. When the printing speed is the color image printing speed, the density detection result and the second data table are first extracted from the memory portion 71, and then a corrected density detection result is obtained from the second data table. The corrected density detection result is written to the memory section. Then corrected density detection result and the first data table are then extracted and compared with each other. The toner density corresponding to the corrected density detection result is determined in the first data table, and will be used as the toner density in the developing tank 20. When the printing speed is the cardboard printing speed, the toner density in the developing tank 20 is determined in a manner similar to that used in the case of the color image printing speed except that the third data table is used instead of the second data table. The calculation result obtained from the toner density calculating section 76 is inputted to the memory portion 71.

The toner replenishment control section 77 controls the toner to be replenished to the developing tank 20 in accordance with the calculation result obtained from the toner density calculating section 76 (hereinafter referred to as "density calculation result"). First, the density calculation result and the reference toner density in the developing tank 20 are extracted from the memory portion 71 and compared with each other. When the density calculation result is lower than the reference toner density, the difference between the reference toner density and the density calculation result is computed. Then, the resultant difference is used to compute the amount of toner to be replenished, and the resultant amount of toner to be replenished is used to determine the number of revolutions of the toner cartridge 24. When the amount of toner to be replenished contains a fraction smaller than the amount of toner discharged per revolution of the toner cartridge 24, the fraction is rounded up and judged as the amount corresponding to one revolution. The toner replenishment control section 77 sends a control signal to the drive section (not shown) (including a power supply (not shown) that supplies drive power to the drive section) that rotates the toner cartridge 24 in accordance with the computation result so as to rotate the toner cartridge 24 by the necessary number of revolutions. In this way, a substantially adequate amount of toner is replenished to the developing tank 20. When the amount of toner to be replenished is only a fraction smaller than the amount of toner discharged per revolution of the toner cartridge 24, the toner replenishment is terminated and the toner density sensor 25 may be controlled to perform the toner density detection earlier.

In the embodiment, the density detection result obtained from the toner density sensor 25 can be corrected in a detection result correcting section which serves as a correcting section. In this way, the toner density in the developing tank 20 can be detected in a more precise manner. Based on the corrected toner density, a more adequate amount of toner can be replenished to the developing tank 20.

For example, the detection result correcting section corrects the control voltage Vc for the toner density sensor 25 in accordance with various correction parameters, and obtains a constant output voltage Vout irrespective of variation with time. The correction parameters are not particularly limited to specific ones as long as they affect the toner density in the developing tank 20. Examples of the correction parameters include a temperature in the image forming apparatus 1, a relative humidity in the image forming apparatus 1, variation with time represented by the amount of reduction in thickness of the photosensitive layer on the surface of the photoreceptor drum 11, and correction values obtained by process control.

The developing roller rotation distance accumulating section 79 accumulates the total rotation distance measured from the point when the developing roller 21 is used for the first time (brand new) to the current point (unit: cm, hereinafter simply referred to as "total rotation distance of the developing roller 21"). The developing roller rotation distance accumulating section 79, for example, extracts the total number of revolutions of the developing roller 21 and the travel distance (cm) per revolution of the developing roller 21 from the memory portion 71, and carries out computation of multiplying them together to determine the total rotation distance of the developing roller 21. The accumulation result obtained from the developing roller rotation distance accumulating section 79 is written to the memory portion 71. The total number of revolutions of the developing roller 21 is detected, for example, by a counter 81 that is provided in the control unit 7 and detects the number of revolutions of the developing roller 21. The detection result obtained from the counter 81 is written to the memory portion 71. The travel distance (cm) per revolution of the developing roller 21 is written in advance to the memory portion 71.

The photoreceptor drum rotation distance accumulating section 80 has the same configuration as that of the developing roller rotation distance accumulating section 79. The photoreceptor drum rotation distance accumulating section 80 accumulates the total rotation distance measured from the point when the photoreceptor drum 11 is used for the first time (brand new) to the current point (unit: cm, hereinafter simply referred to as "total rotation distance of the photoreceptor drum 11"). The photoreceptor drum rotation distance accumulating section 80, for example, extracts the total number of revolutions of the photoreceptor drum 11 and the travel distance (cm) per revolution of the photoreceptor drum 11 from the memory portion 71, and carries out computation of multiplying them together to determine the total rotation distance of the photoreceptor drum 11. The accumulation result obtained from the photoreceptor drum rotation distance accumulating section 80 is written to the memory portion 71. The total number of revolutions of the photoreceptor drum 11 is detected, for example, by a counter 82 that is provided in the control unit 7 and detects the number of revolutions of the photoreceptor drum 11. The detection result obtained from the counter 82 is written to the memory portion 71. The travel distance (cm) per revolution of the photoreceptor drum 11 is written in advance to the memory portion 71.

The toner density correcting section 83 corrects the toner density in accordance with process control as one of the correction parameters. The correction is performed, for example, by using the patch forming section 84 and the patch density correcting section 85. The patch forming section 84 controls the toner image forming section 2 to form a toner patch, which is a toner image for detecting toner density, on the surface of the photoreceptor drum 11. For example, eight approximately 8-cm squares are formed as the toner patch. The patch forming section changes forming conditions and forms a plurality of toner patches, the toner densities, that is, patch densities, of which continuously change. A plurality of toner patches are preferably formed in correspondence with the printing densities that can be set in the image forming apparatus 1. The forming conditions herein include the developing bias voltage applied to the developing roller 21, the charge voltage (charge potential) applied to the surface of the photoreceptor drum 11, and the charge voltage (exposure potential) of an electrostatic latent image formed by the exposure unit 16 on the surface of the photoreceptor drum 11. One or more of the above conditions are set to fixed values and each of the remaining conditions is appropriately changed by a fixed amount at a time. In this way, a plurality of toner patches having continuously changing patch densities are formed. For example, the charge potential and the exposure potential may be set to fixed values and the developing bias voltage may be changed by a fixed amount at a time to form a plurality of toner patches. The forming conditions (such as the developing bias voltage) of the plurality of toner patches are written to the memory portion 71.

The patch density detecting section 28 detects the patch density of a toner patch on the surface of the photoreceptor drum 11. The detection result obtained from the patch density detecting section 28 (hereinafter referred to as "patch density detection result") is written to the memory portion 71. A reference patch density determined in the design phase of the image forming apparatus 1 is written in advance to the memory portion 71. The reference patch density is written, for example, as the amount of reference reflected light in the case of a monochrome image and as the amount of scattered light in the case of a color image. After the patch density detecting section 28 detects patch densities, the cleaning unit 14 removes the toner patches from the surface of the photoreceptor drum 11. The control unit 7 extracts the patch density detection results and the reference patch density from the memory portion 71, compares the extracted values with each other, reads the developing bias voltage value used to form the toner patch having a patch density closest to the reference patch density, determines the difference from the developing bias voltage for the reference patch density, and writes the difference as the amount of developing bias correction to the memory portion 71.

Correction to the sensitivity of the toner density sensor 25 will be described below.

The relationship between the control voltage and the output voltage of the toner density sensor 25 greatly varies with the sensitivity of the toner density sensor 25. That is, when the sensor has a high sensitivity (sensitivity Max), the output voltage greatly changes with a slight change in the control voltage. When the sensor has a low sensitivity (sensitivity Min), the output voltage does not greatly change with the control voltage. When the sensor has an average sensitivity (sensitivity Mid), the change in the output voltage is substantially the same as the change in the control voltage.

Figure 3:
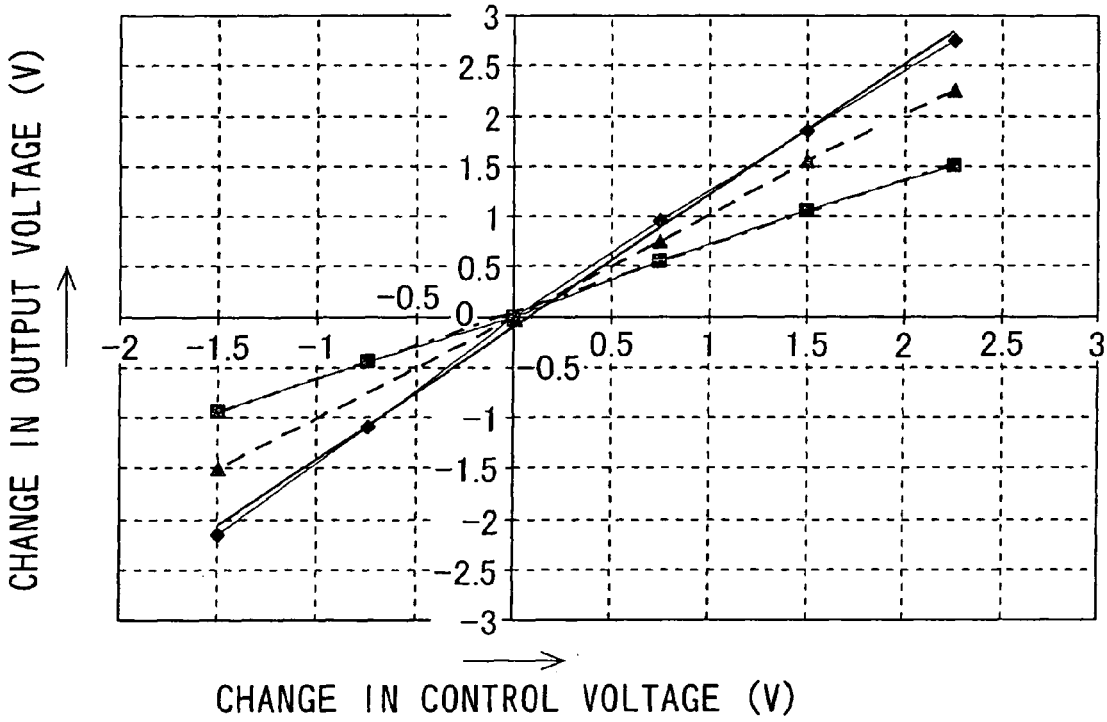
FIG. 3 is a graph illustrating the correlation between the change in the control voltage and the change in the output voltage.

FIG. 3 is a graph illustrating the correlation between the change in the control voltage and the change in the output voltage. The horizontal axis represents the change in the control voltage, and the vertical axis represents the change in the output voltage.

It is seen from the correlation between the control voltage and the output voltage that with respect to a gradient, the sensitivity Max (solid line) is the largest and the sensitivity Mid (broken line) and the sensitivity Min (dashed-dotted line) become small in this order.

A sensitivity coefficient of the toner density sensor 25 is calculated based on the graph in FIG. 3. The sensor under consideration is a sensor in which the ratio of the control voltage to the output voltage is 1:1, that is, a sensor in which the output voltage changes by 1 V when the control voltage changes by 1 V.

The change in the output voltage when the control voltage is changed by ±1.5 V (3 V) is calculated, and 3 V divided by the calculated change is defined as the sensitivity coefficient.

The change in the output voltage when the control voltage is changed by ±1.5 V (3 V) may be calculated by using the graph in FIG. 3 to determine in advance the relationship between the change in the control voltage, x, and the change in the output voltage, y, in the form of an approximate linear equation.

In the example of FIG. 3, the approximate equations are obtained as follows: $y=1.3067x-0.1067$ for the sensitivity Max, $y=1.0054x+0.0068$ for the sensitivity Mid, and $y=0.659x+0.0362$ for the sensitivity Min.

Therefore, the sensitivity coefficient are obtained as follows: $3/(1.3067\times3-0.1067)=0.78$ for the sensitivity Max, $3/(1.0054\times3+0.0068)=0.99$ for the sensitivity Mid, and $3/(0.659\times3+0.0362)=1.49$ for the sensitivity Min.

It has been found the longer the developer used, the more degraded it becomes, and the sensitivity of the toner density sensor 25 changes accordingly.

Therefore, the sensitivity coefficient is recalculated for each predetermined time interval or whenever a predetermined condition is satisfied, and the control voltage is corrected based on the recalculated sensitivity coefficient.

Examples of the predetermined condition are the time of start-up of the apparatus, the time at which the accumulated number of printed sheets reaches a predetermined number, and the time of carrying out process control.

Using the sensitivity coefficients according to the sensitivities of the toner density sensor 25, for example, the sensitivity coefficient for the sensitivity Mid is set to the reference value, and for each of the sensitivities Max and Min, the ratio of the sensitivity to the reference value is calculated. The ratio of the sensitivity Max to the sensitivity Mid is 0.78/0.99=0.788, and the ratio of the sensitivity Min to the sensitivity Mid is 1.49/0.99=1.51.

Provided that, as the reference, the control voltage is reduced by 1.44 V to lower the toner density by 2%, the control voltage may be reduced by 0.72 V per toner density of 1%. However, since the sensitivity of the toner density sensor 25 changes, the correction cannot be carried out in a proportional manner. Table 1 is an example showing the toner density correction values according to the cumulative number of printed sheets and the corresponding control voltage correction values.

TABLE 1

| Cumulative number of printed sheets (K) | Toner density correction (%) | Expected voltage correction (V) | Sensitivity coefficient | Actual Voltage Correction (v) |
|---|---|---|---|---|
| 0 | 0 | 0 | 0.99 | 0 |
| 10 | −0.5 | −0.36 | 0.98 | −0.35 |
| 20 | −1 | −0.72 | 0.97 | −0.70 |
| 30 | −1.5 | −1.08 | 0.96 | −1.04 |
| 40 | −2 | −1.44 | 0.94 | −1.35 |
| 50 | −2.5 | −1.80 | 0.92 | −1.66 |
| 60 | −3 | −2.16 | 0.9 | −1.94 |

The cumulative number of printed sheets is the number of printed sheets accumulated from the point when an unused toner is used for the first time. It is noted that the cumulative numbers of printed sheets shown in the table are representative values. For example, 0 represents 0K to 9.999K, that is, 0 to 9,999.

Whenever the cumulative number of printed sheets increases by 10K (10,000), the toner density in the developing device is corrected. When the cumulative number of printed sheets is 0K, the toner density and other parameters are 0 because no correction is required.

When the cumulative number of printed sheets is 10K, the toner density is corrected by lowering it by 0.5%. Since the amount of control voltage correction is set to −1.44 V as the reference to lower the toner density by 2%, the expected amount of control voltage correction is −1.44×(0.5/2)=−0.36 V. To take into account the variation in sensitivity of the toner density sensor 25, the sensitivity coefficient is calculated and the expected amount of correction is multiplied by the sensitivity coefficient to calculate the actual amount of correction.

Therefore, when the cumulative number of printed sheets is 10K, the sensitivity coefficient is 0.98, and the actual amount of control voltage correction is −0.36×0.98=−0.35 V.

The procedure described above is carried out whenever the cumulative number of printed sheets increases by 10K, and the results are shown in Table 1.

In this example, the correction based on the cumulative number of printed sheets has been described. However, the correction is not necessarily carried out as described above. For example, the sensitivity coefficient may be calculated when process control is performed, and then the amount of control voltage correction may be calculated.

Taking into account the variation with time in the sensitivity of the toner density sensor 25 allows the toner density control to be performed on each developing device in the same manner, and hence the variation in toner consumption can be eliminated.

As described above, since the control voltage is affected by temperature and humidity as well as the variation in the sensitivity of the toner density sensor 25, it is desirable to correct the control voltage not only for the variation in the sensitivity but also for temperature and humidity.

Table 2 shows the amount of control voltage correction for temperature, and Table 3 shows the amount of control voltage correction for humidity.

TABLE 2

| Temperature (° C.) | Toner density correction (%) | Voltage correction (V) |
|---|---|---|
| 0-5 | 1 | 0.72 |
| 5.1-10 | 0.66 | 0.48 |
| 10.1-15 | 0.33 | 0.24 |
| 15.1-25 | 0 | 0 |
| 25.1-35 | −0.33 | −0.24 |
| 35.1-45 | −0.66 | −0.48 |
| 45.1- | −1 | −0.72 |

TABLE 3

| Humidity (relative) (%) | Toner density correction (%) | Voltage correction (V) |
|---|---|---|
| 0-10 | 1 | 0.72 |
| 10.1-20 | 0.66 | 0.48 |
| 20.1-30 | 0.33 | 0.24 |
| 30.1-50 | 0 | 0 |
| 50.1-65 | −0.33 | −0.24 |
| 65-80 | −0.66 | −0.48 |
| 80- | −1 | −0.72 |

As an example, calculate the amount of control voltage correction in the following conditions: a temperature of 12° C., a humidity of 25%, and the cumulative number of printed sheets of 25K (25,000).

From Table 2, the correction voltage for a temperature of 12° C. is 0.24 V, and from Table 3, the correction voltage for a humidity of 25% is 0.24 V. From Table 1, the correction voltage for the cumulative number of printed sheets of 25K is −0.72×0.97=−0.70 V.

The amount of control voltage correction in consideration of the variation in the sensitivity of the toner density sensor 25, temperature, and humidity is the sum of the respective correction voltages: 0.24+0.24+(−0.70)=−0.22 V.

In a color image forming apparatus, there are a plurality of developing devices for the respective colors of the developer, and the sensitivities of the toner density sensors 25 differ from one another. Depending on the toner density sensor 25 provided in the developing device, the sensitivity coefficient is modified by the modifying section 86.

For developing devices with toner density sensors 25 having sensitivities Max and Min, the sensitivity coefficient, which is the reference value, is recalculated for the developing device with the toner density sensor 25 having the sensitivity Min. The ratio of the resultant sensitivity coefficient to the reference value described above is used to recalculate the sensitivity coefficients for the toner density sensors 25 having the sensitivities Max and Min. The recalculated sensitivity coefficients are used to determine the amounts of control voltage correction. In this way, an image can be formed without causing a difference in toner consumption between the developing devices.

As another embodiment of the invention, it is also possible to provide an image formation program that causes a computer to operate the image forming apparatus described above, as well as a computer-readable recording medium on which the image formation program is recorded.

The recording medium may be a memory itself that the CPU uses to perform processing, such as a RAM and a ROM (Read Only Memory), or may be a recording medium that is readable when inserted into a program reader provided as a computer external storage device. In both cases, the recorded image formation program may be executed by causing the CPU to access the recording medium, or by causing the CPU to read the image formation program from the recording medium and download the read image formation program to a program storage area. The downloading program has been stored in a predetermined storage device. The CPU oversees the control of various portions in the computer so that predetermined image formation is carried out in accordance with the installed image formation program.

The recording medium readable by a program reader may be media that permanently record a program, including tapes, such as a magnetic tape and a cassette tape; disks, for example, magnetic disks, such as a flexible disk and a hard disk, and optical disks, such as a CD-ROM (Compact Disc-Read Only Memory), an MO (Magneto-Optical Disc), an MD (Mini Disc), and a DVD (Digital Versatile Disc); cards, such as an IC (Integrated Circuit) card (including a memory card) and an optical card; and semiconductor memories, such as a mask ROM, an EPROM (Erasable Programmable Read Only Memory), an EEPROM (Electrically Erasable Programmable Read Only Memory), and a flash ROM.

In a configuration in which a computer can be connected to a communication network including the Internet, the recording medium may be a medium that temporarily carries a program, such as an image formation program downloaded from the communication network. When an image formation program is thus downloaded from the communication network, the downloading program may be stored in the computer in advance, or may be installed from another recording medium.

An exemplary computer system that executes an image formation program read from such a recording medium is a system including the following components connected to one another: an image reader, such as a flatbed scanner, a film scanner, and a digital camera; a computer that performs various processes including the image formation method described above by executing various programs; an image display device that displays the processed results obtained from the computer, such as a CRT (Cathode Ray Tube) display and a liquid crystal display; and an image output device that outputs the processed results obtained from the computer, for example, on a sheet of paper, such as a printer. The computer system further includes a modem for connecting the computer system to, for example, a server via the communication network and sending and receiving various data, such as various programs including the image formation program and image data.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device comprising:

a developing roller that supplies toner to an electrostatic latent image formed on a surface of a photoreceptor to form a toner image;

a developing tank that stores a two-component developer containing toner;

a toner density detecting section that detects a toner density in the developing tank and outputs a detection result, an output value of the detection result changing in accordance with an input control value;

a correcting section that calculates a sensitivity coefficient regarding a sensitivity of the toner density detecting section, which is indicative of a correlation between the control value and the output value, and corrects the control value based on the calculated sensitivity coefficient; and a toner density calculating section that calculates the toner density in the developing tank using the detection result obtained from the toner density detecting section to which the corrected control value is inputted, the correcting section recalculating the sensitivity coefficient for each predetermined time interval or whenever a predetermined condition is satisfied, calculating an actual amount of correction from a product of the recalculated sensitivity coefficient and a correction voltage value that is expected from a reference value of the control value and the toner density, and correcting the control value based on a sum of the calculated actual amount of correction, a voltage value that is determined depending on a temperature detected by a temperature sensor, and a voltage value that is determined depending on a humidity detected by a humidity sensor.

2. The developing device of claim 1, wherein the predetermined condition is a time of start-up of the apparatus, a time at which the accumulated number of printed sheets reaches a predetermined number, or a time of carrying out process control.

3. An image forming apparatus for forming an image with electrophotography, comprising a plurality of the developing devices of claim 1, each of the developing devices including a modifying section that modifies the sensitivity coefficient regarding the sensitivity of the provided toner density detecting section, and the correcting section correcting the control value based on the sensitivity coefficient modified by the modifying section.

4. A developing method in which toner is supplied to an electrostatic latent image formed on a surface of a photoreceptor to form a toner image, the method comprising the steps of:

calculating a sensitivity coefficient regarding a sensitivity of a toner density detecting section, which is indicative of a correlation between a control value and an output value for each predetermined time interval or whenever a predetermined condition is satisfied;

calculating an actual amount of correction from a product of the calculated sensitivity coefficient and a correction voltage value that is expected from a reference value of the control value and the toner density;

correcting the control value based on a sum of the calculated actual amount of correction, a voltage value that is determined depending on a temperature, and a voltage value that is determined depending on a humidity;

outputting a detection result of the toner density in a developing tank in accordance with the corrected control value; and calculating the toner density in the developing tank using the detection result of the toner density.

5. A non-transitory computer-readable recording medium on which an image processing program is recorded, the program configured to control the image forming apparatus of claim 3.

* * * * *